US006182484B1

(12) United States Patent
Wolter

(10) Patent No.: US 6,182,484 B1
(45) Date of Patent: Feb. 6, 2001

(54) KEY HOLDER WITH LAMP

(76) Inventor: Heinz Wolter, Meiswinkel 3, D-51515 Kürten (DE)

( * ) Notice: Under 35 U.S.C. 154(b), the term of this patent shall be extended for 0 days.

(21) Appl. No.: 09/205,149

(22) Filed: Dec. 3, 1998

(30) Foreign Application Priority Data

Dec. 6, 1997 (DE) ..... 197 54 193

(51) Int. Cl.[7] ..... F21V 33/00; E05B 19/04
(52) U.S. Cl. ..... 70/395; 70/408; 362/116
(58) Field of Search ..... 70/395, 408, 454, 70/456 R, 278.2, 278.3, 283.1; 362/100, 116

(56) References Cited

U.S. PATENT DOCUMENTS

| | | | | |
|---|---|---|---|---|
| 2,164,148 | * | 6/1939 | Swanson | 70/456 R |
| 2,208,498 | * | 7/1940 | Cramer | 70/456 R |
| 2,640,347 | * | 6/1953 | Majeski | 70/456 R |
| 2,738,668 | * | 3/1956 | Rock | 70/456 R |
| 3,022,408 | * | 2/1962 | Wagner | 70/395 |
| 3,099,399 | * | 7/1963 | Kibby | 70/456 R X |
| 3,119,564 | * | 1/1964 | Zalman | 70/456 R X |
| 3,296,429 | * | 1/1967 | Schwartz | 70/456 R X |
| 3,310,668 | * | 3/1967 | Schwartz . | |
| 4,303,966 | * | 12/1981 | Wolter | 362/116 |
| 4,521,833 | * | 6/1985 | Wolter | 70/456 R X |
| 4,562,712 | * | 1/1986 | Wolter | 70/395 X |
| 4,831,504 | * | 5/1989 | Nishizawa et al. | 70/456 R X |
| 4,888,970 | * | 12/1989 | Kinzler et al. | 70/456 R |
| 5,730,013 | * | 3/1998 | Huang | 70/408 X |
| 6,006,562 | * | 12/1999 | Wolter | 70/456 R |

FOREIGN PATENT DOCUMENTS

| | | | | |
|---|---|---|---|---|
| 1089478 | * | 9/1960 | (DE) . | |
| 1919439 | * | 7/1965 | (DE) . | |
| 1943992 | * | 5/1966 | (DE) . | |
| 2827560 | * | 1/1980 | (DE) . | |
| 3902537 | * | 8/1990 | (DE) | 70/456 R |
| 4141270 | * | 6/1993 | (DE) | 70/408 |
| 1425414 | * | 12/1965 | (FR) | 70/408 |
| 2039321 | * | 8/1980 | (GB) | 70/395 |
| 4011179 | * | 1/1992 | (JP) | 70/395 |
| 4080482 | * | 3/1992 | (JP) | 70/408 |

* cited by examiner

*Primary Examiner*—Lloyd A. Gall
(74) *Attorney, Agent, or Firm*—Martin A. Farber

(57) ABSTRACT

A key holder (1) with lamp, comprising a two-part housing, of which one housing part (2) bears as source of illumination (incandescent lamp 7) and has a first section (A) of a battery-receiving chamber (B) which is provided with a button (19) and of which the second section (A1) is formed by the other housing part (3), each housing part (2, 3) receiving one of the two contact elements (14, 40) in each case. The end sections (16, 41) of the contact elements (14, 40) are assigned to the two broad surfaces of the battery-receiving chamber (B) and are located opposite one anther at a distance which is greater than the distance between the two broad surfaces (29, 49) of the button-cell battery, and one of the two contact end sections (16, 41), upon actuation of the button, be displaced in the direction of the other contact end section.

1 Claim, 4 Drawing Sheets

Fig. 1
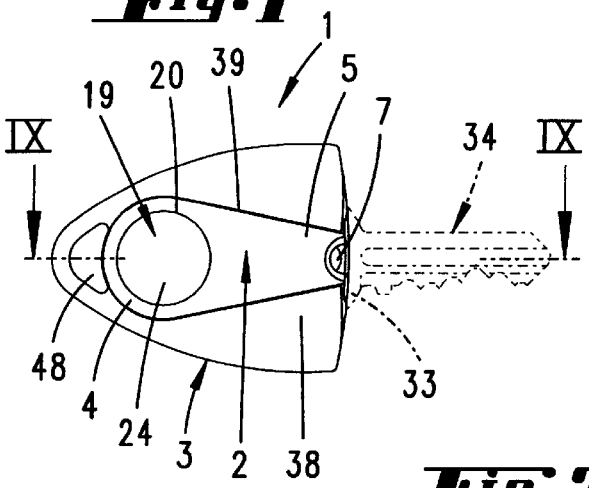
Fig. 2
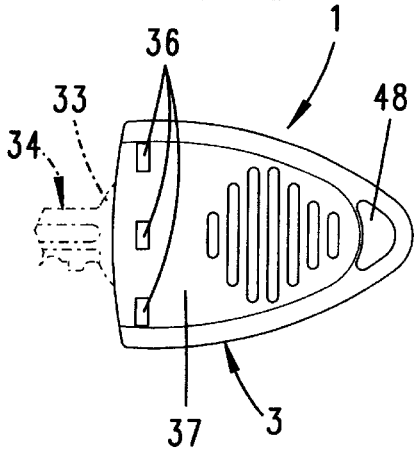
Fig. 3
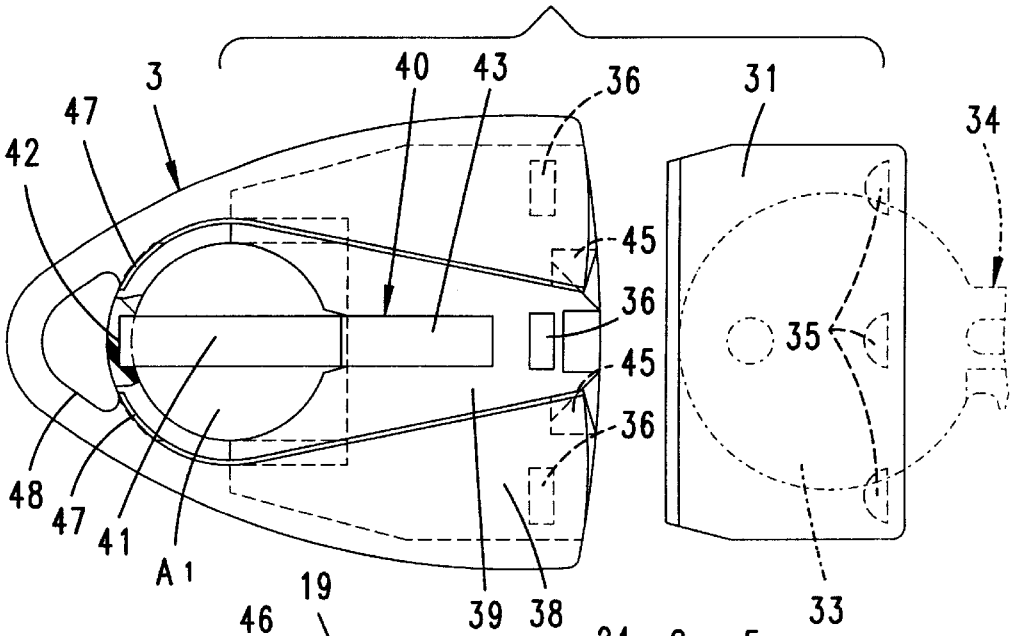
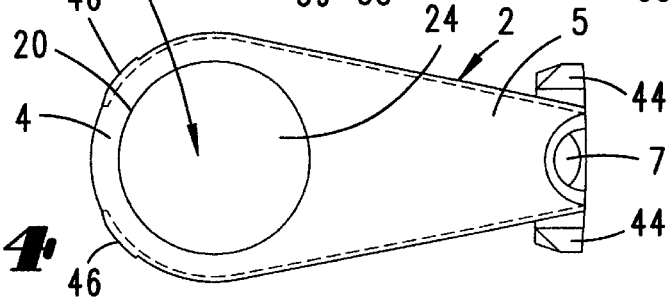
Fig. 4

KEY HOLDER WITH LAMP

FIELD AND BACKGROUND OF THE INVENTION

The invention relates to a key holder with lamp, comprising a two-part housing, of which one housing part bears an illumination means and has a first section of a battery-receiving chamber which is provided with a button and of which the second section is formed by the other housing part, each housing part receiving one of the two contact elements in each case.

A key holder with lamp of the type in question is known from DE 28 27 560 C2, that housing part which is larger in plan view, and receives the key grip, bearing a conically wound compression spring, of which the larger, base coil is supported on the one contact element and of which the top coil is supported on the facing broad surface of a button-cell battery positioned in the battery receiving chamber. In order to switch on the lamp, the button is actuated, this button acting on the battery counter to the force of the conical compression spring and thus bringing the border edge of the button-cell battery into contact with the other contact element, the lamp circuit being closed in the process.

SUMMARY OF THE INVENTION

The object of the invention is to design a key holder with lamp of the Introductory-mentioned type so that, while being of a more straightforward construction, it is more advantageous in terms of usage.

This object is achieved first and foremost in the case of a key holder having the features of the Invention, wherein the contact end sections of the contact elements are assigned to the two broad surfaces of the battery housing receiving chamber and are located opposite one another at a distance which is greater than the distance between the two broad surfaces of the button-cell battery, and one of the two contact end sections, upon actuation of the button, is displaced in the direction of the other contact end section.

Such a configuration provides a key holder with lamp of the Introductory-mentioned type which, in addition to a straightforward construction, is distinguished by being more useful. It is possible, then, for the compression spring provided between the one broad surface of the button-cell battery and the one contact element to be dispensed with, this being associated with a reduction in the number of components. It is no longer necessary either for the button-cell battery, upon actuation of the button, to be displaced, overcoming the force of the compression spring in the process, in order for said button-cell battery to come to rest against the other contact element. The two contact end sections of the contact elements, then, are assigned to the two broad surfaces of the battery-receiving chamber. The distance between them is greater than the distance between the two broad surfaces of the button-cell battery. Upon actuation of the button, electrical contact with the button-cell battery is established such that the contact end section which is directed toward the button is displaced by the latter in the direction of the other contact end section, this being associated with the two broad surfaces of the button-cell battery, said surfaces having different polarities, achieving current-conducting connection as intended. This measure makes it possible for the button-cell battery to be secured non-displaceably in the battery-receiving chamber. This simplifies battery changing to a not inconsiderable extent. It is recommendable for the button to be made of flexible plastic such that the cup base, with the button-cell battery inserted in it, is located at an appropriate distance from the broad surface of the battery. The relevant contact end section extends in this interspace. Actuation of the button results in the cup base being pushed in, this being associated with the contact end section being carried along, said displacement being limited by the facing broad surface of the battery. In this pushed-in position of the cup base, electrical contact is then established, this producing the current flow to the illumination means, which is configured as an incandescent lamp. It is advantageous here for the button-cell battery to be retained with a clamp fit by the cup wall. Accordingly, there is a constant distance between the cup base and that broad surface of the button-cell battery which is directed toward it. For the purpose of changing the button-cell battery then the latter, while the two-part housing is separated into its two parts, can be assigned to the button in captive fashion, this being brought about by the cup wall, which partially encloses the button-cell battery. When the housing part which bears the button, the button-cell battery and the incandescent lamp is placed in position, it is not possible for the button-cell battery to drop out. All the essential electrical components are retained by this one housing part in captive fashion. The other housing part bears just the other contact element, this too being retained in captive fashion. Furthermore, it should be emphasized that the one contact end section is located on the base of the cup. The contact end section is thus carried along directly upon actuation of the button. Furthermore, it is ensured that, when the button is not actuated, there is a sufficient distance between the facing broad surface of the button-cell battery and the contact end section, with the result that the lamp cannot be switched on unless desired. It has been found again and again in practice that the lamp-base contact is dimensioned in different sizes and, accordingly, cannot always come into contact with the contact element. This problem is eliminated according to the invention in that the contact which comes to rest against the lamp-base contact forms a compression spring, of which the rectilinear end section forms the contact end section. This ensures that, even with a wide range of different conditions, contact is always reliably made with the lamp-base contact. The contact element which is assigned to the other housing part, in contrast, is a Z-shaped metal strip, of which the planar end forms the one contact end section. The button is positioned securely in the one housing part in that its cup border is secured on said housing part. This securing operation can take place, for example, by rear engagement, in that the cup border forms outwardly oriented protrusions which engage behind the one housing part. In order that the contact element assigned to the one housing part can be fitted easily and is retained securely in the fitted position, that is to say in the use position, it is the case that, behind the incandescent lamp, a chamber, which receives the compression spring, is plugged into the one housing part with a form fit, in a clamping manner, transversely with respect to the longitudinal direction of the extent of the lamp. The contact end section projects out of the rear wall of said chamber such that it rests on the base of the cup.

BRIEF DESCRIPTION OF THE DRAWINGS

With the above and other objects and other advantages in view, the present invention will become more clearly understood in connection with the detailed description of a preferred embodiment, when considered with the accompanying drawings of which:

FIG. 1 shows a view of a key holder with the key illustrated by chain-dotted lines and with the housing part which contains the incandescent lamp and button also illustrated;

FIG. 2 shows a rear view of the key holder;

FIG. 3 shows, on an enlarged scale, a view of the key holder, with one housing part removed, before a plate connected to the key grip is pushed in;

FIG. 4 shows a view of the one housing part alone, from which it is possible to see the incandescent lamp and the button;

DETAILED DESCRIPTION OF THE PREFERRED EMBODIMENT

Figure 5:
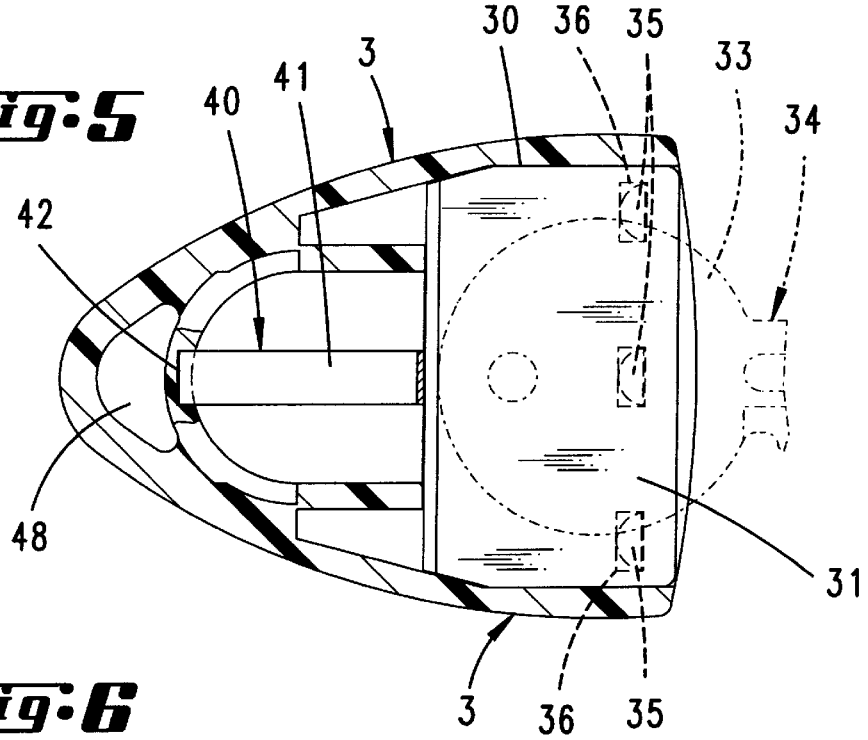
FIG. 5 shows a longitudinal section through the other housing part in the region of its shaft for receiving the plate connected to the key grip.

The key holder with lamp is designated overall by the designation 1. It has a two-part housing, comprising two housing parts 2 and 3. The one housing part 2 is of elongate configuration. The one end 4 of said one housing part 2 runs in the form of a semicircle and tapers toward the other end 5. Located in the latter, in the longitudinal extent of the housing part 2, is a channel 6 for receiving an illumination means configured as an incandescent lamp 7. The lamp base 8 is positioned in the channel 6 with a form fit and forms a lamp-base contact 9 at the end. The channel 6 is adjoined by a recess 10 for receiving a chamber 11 with a form fit, in a clamping manner. Said chamber is provided, in coaxial alignment with the channel 6, with a receiving cavity 12 in which a compression spring 13 is positioned. The latter is a constituent part of the contact element 14, which is assigned to the lamp-base contact 9. In this case, the compression spring 13 constitutes the contact of the contact element 14 which comes to rest against the lamp-base contact. That end of the compression spring 13 which is directed toward the lamp-base contact 9 comes to rest under stressing against the lamp-base contact 9, with result that even with the lamp-base contact configured in different sizes, which is often the case during production, the proper electrical contact is always established.

The incandescent lamp 7 is positioned in the channel 6 such that the lamp base 8 terminates with the border edge of the channel 6. The chamber 11, which is plugged into the recess 10, also terminates at the same level. The receiving cavity 12 is a blind bore. Extending from the base of the blind-bore-like receiving cavity 12, said base forming the rear wall 11' of the chamber, is an opening 15 for the through-passage of the contact end section 16, which adjoins the compression spring 13 in a rectilinear manner.

Following the opening 15, the contact end section 16 engages through a hole 17 in the cup wall 18 of a cup-like button 19 received by the one housing part 2. The cup wall 18 of said button runs concentrically with respect to the semicircular end 4 of the housing part 2. In order that the hole 17 is always properly aligned with respect to the opening 15, the button 19, which is inserted into a clearance 20 which is circular in plan view, has, on the outside of the cup wall 18, three grooves 21 which are offset with respect to one another by 90° and are intended for the form-fitting introduction of webs 22 which are provided in the same arrangement and extend from the inner wall of a cavity 23 located coaxially with respect to the clearance 20.

Figure 6:
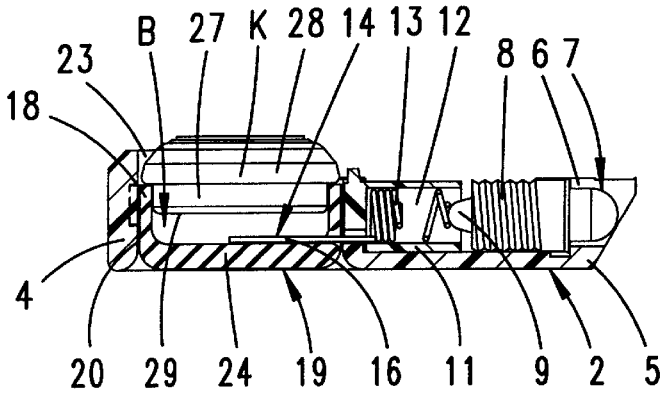
FIG. 6 shows the section along line VI—VI in FIG. 7.
Figure 8:
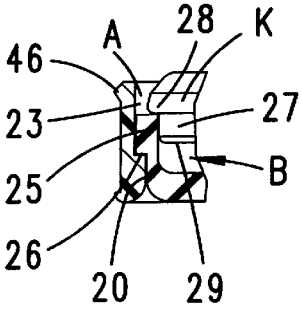
FIG. 8 shows the section along line VIII—VIII in FIG. 7.
Figure 7:
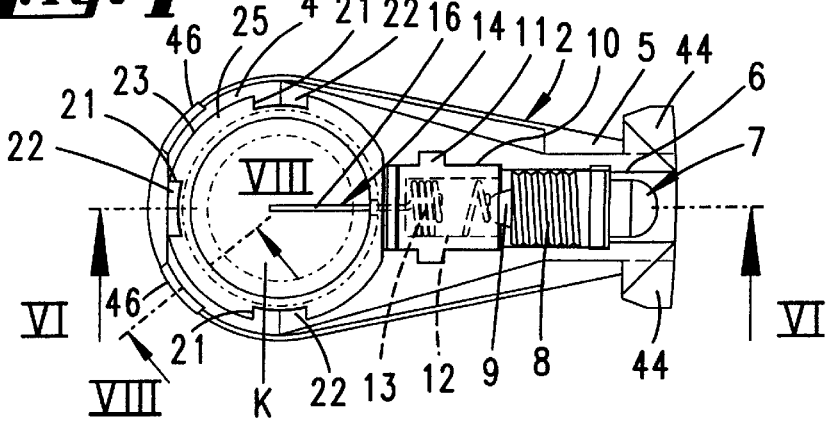
FIG. 7 shows a plan view of FIG. 6.
Figure 9:
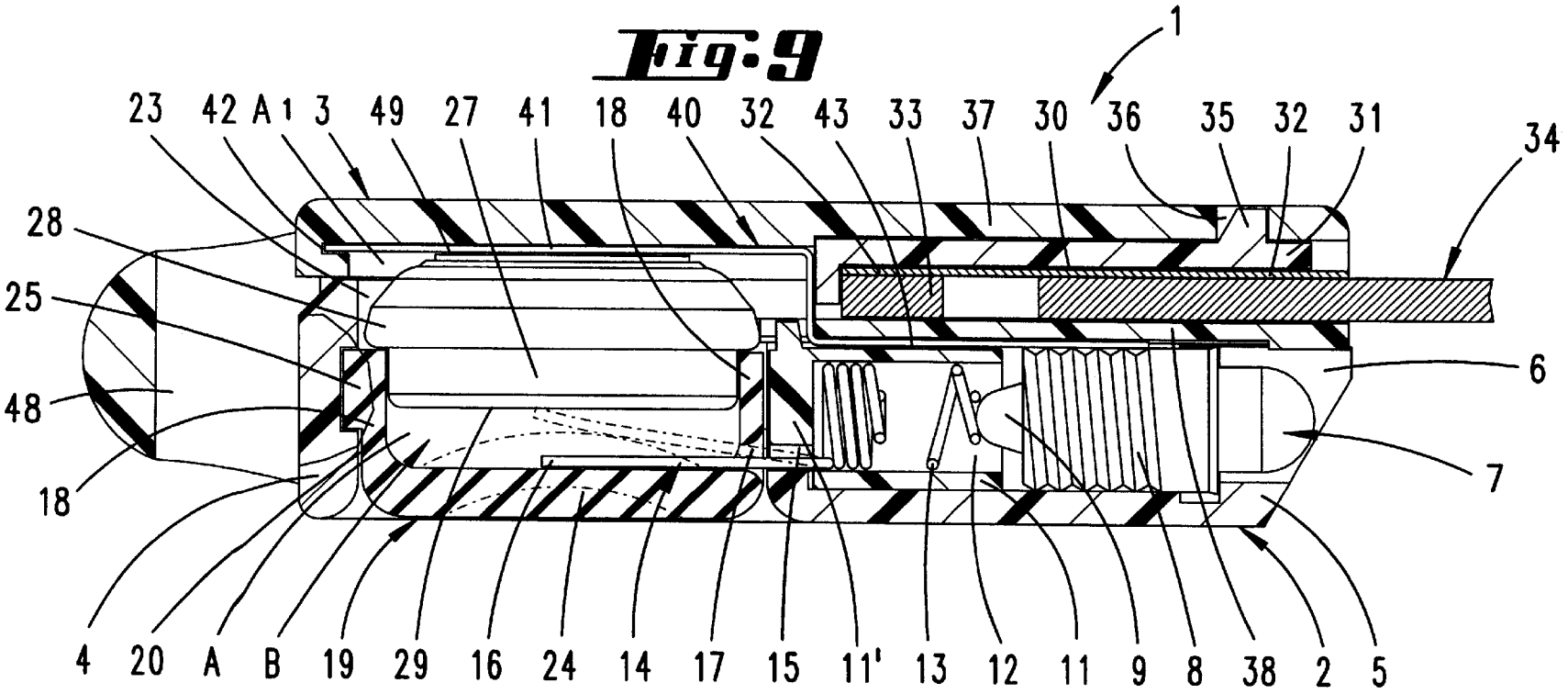
FIG. 9 shows a vastly enlarged illustration of the section along line IX—IX in FIG. 1.

With the button 19 fitted, the outer surface of the cup base 24 terminates flush with the facing surface of the housing part 2, see FIGS. 6 and 9. Serving for the purpose of securing the position of the button 19 once inserted is a collar 25 which has the grooves 21 made in it and engages behind a stepped section 26 between the clearance 20 and cavity 23. In contrast to the housing part 2, which is produced from plastic, the button 19 consists of flexible plastic, such that the cup base 24 can be pushed in.

In conjunction with the cavity 23, the cup interior forms a first section A of a battery-receiving chamber B. The battery which is to be inserted is a button-cell battery K, of which the end section 27, which is offset in the form of a step, is retained with a clamp fit by the cup wall 18. Plugging in of the button-cell battery K is limited by the border 28 of the button-cell battery K, said border adjoining the end section 27 and being supported on the border edge of the cup wall 18. With the button 19 inserted, the contact end section 16 rests against the base 24 of the cup. As FIGS. 6 and 9 illustrate clearly, there is thus a distance between the contact end section 16 and the facing broad surface 29 of the button-cell battery K, this broad surface 29 forming the positive terminal.

The housing part 3, which is larger in plan view than the housing part 2 and is produced from plastic, is configured in the form of an isosceles triangle with curved sides. A shaft 30 extends from the shorter curved side. A carrier plate 31 can be plugged into said shaft with a form fit. The carrier plate 31 is provided on the one side with a self-adhesive layer 32, which serves for securing the key grip 33 of a key 34. Opposite the self-adhesive layer 32, the carrier plate 31 has latching protrusions 35 which, with the carrier plate pushed in to the full extent, engage in latching openings 36 of the rear wall 37 of the other housing part 3, said rear wall being adjacent to the shaft 30.

The shaft wall 38, which is located opposite the rear wall 37, is provided with a depression 39 which is adapted to the outline of the one housing part 2. The depression 39 passes into the second section A1 of the battery-receiving chamber B. A planar end of a Z-shaped metal strip runs on the base of said section A1. Said metal strip forms the contact element 40, which is assigned to the housing part 3, the planar end constituting the contact end section 41. The end of the latter is positioned with a form fit in a niche 42 of the housing part 3. The other planar end of said Z-shaped contact element 40 constitutes the other contact end section 43, rests on the base of the depression 39 and rests with electrical contact against the wall of the lamp base 8.

Figure 10:
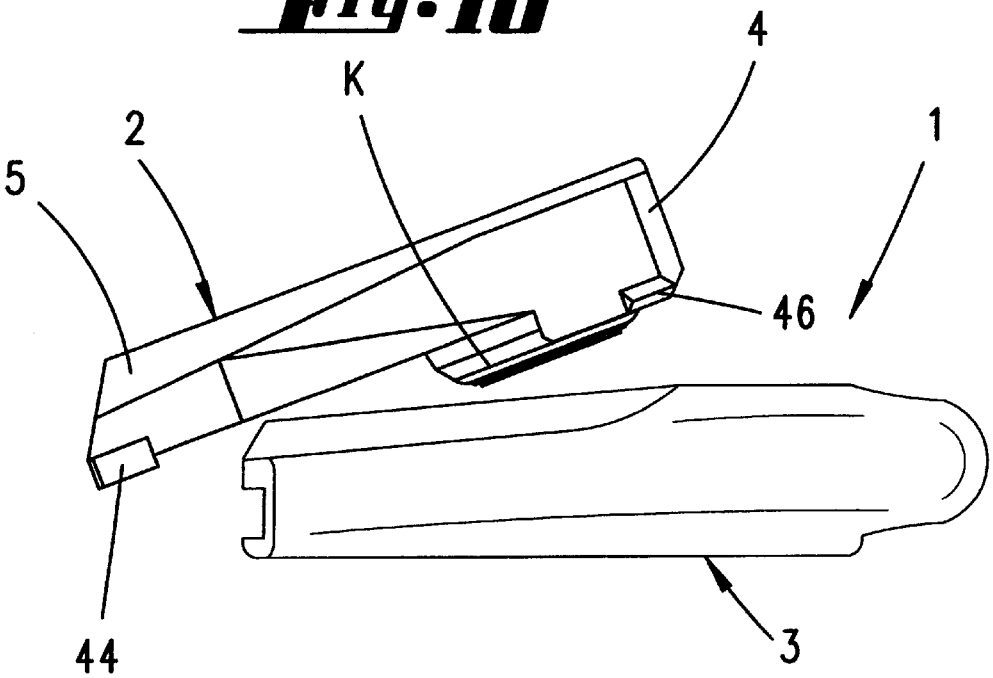
FIG. 10 shows the alignment of the one housing part with respect to the other housing part for the purpose of connecting the two housing parts to one another.
Figure 11:
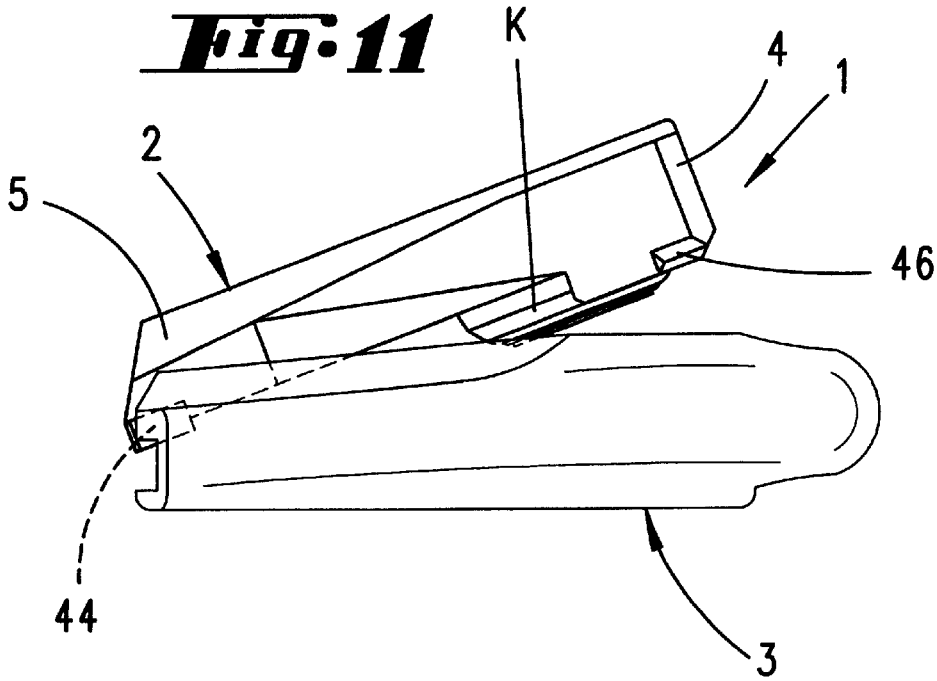
FIG. 11 shows the hook-in position between the two housing parts, which, by subsequently being swung together, achieve latching engagement.

Projecting beyond the front, narrower end 5 of the one housing part 2 are diametrically opposite hook-in protrusions 44, which engage with a form fit in hook-in openings 45 of the other housing part 3. Said hook-in openings are adjacent to the plug-in end of the shaft 30. The semicircular end 4 of the housing part 2 is provided with two latching protrusions 46 which form latching ramps and, following production of the hook-in connection, see FIGS. 10 and 11, and subsequent pivoting of the housing part 2 in the direction of the housing part 3, engage behind latching webs 47. These latching webs 47 flank a hang-up opening 48 of the other housing part 3, said opening being located opposite the shaft 30. With the housing parts 2, 3 connected to one another, the broad surface 49, which forms the negative terminal, is directed toward the contact end section 41 of the contact element 40. Contact may thus take place between the contact end section 41 and the facing broad surface 49 of the button-cell battery K.

As can be seen clearly, in particular, from FIG. 9, the contact end sections 16 and 41 are assigned to the two broad surfaces of the battery-receiving chamber B. They are spaced apart from one another by a distance which is greater than the distance between the two broad surfaces 29, 49 of the button-cell battery K.

If it is intended to close the circuit to the incandescent lamp 7, then the button 19 is actuated at its base 24, this being associated with displacement of the contact end section 16 in the direction of the other contact end section 41. In this case, the button-side contact end section 16, as is illustrated by chain-dotted lines in FIG. 9, is moved toward the facing broad surface 29 of the button-cell battery K. The pressure exerted in this case results in reliable electrical contact between the broad surfaces of the button-cell battery and the contact elements 16, 41, even if there is no physical contact between the contact end section 41 and the facing broad surface 49 of the button-cell battery. The circuit is thus always reliably closed upon actuation of the button.

The operation of exchanging a button-cell battery requires the latching engagement between the latching protrusions 46 and latching webs 47 to be released. Thereafter, the one housing part 2 can be pivoted away, and disengaged, from the other housing part 3. The used-up button-cell battery can be removed and exchanged for a new one. The button-cell battery K then remains in its plugged-in position as a result of its clamp fit with respect to the button 19. Furthermore, the contact element 14 and incandescent lamp 7 are retained on the housing part 2 in captive fashion, with the result that the latching connection between the housing parts 2, 3 can easily be reestablished without components having to come out of their intended position in the process.

What is claimed is:

1. A key holder with lamp, comprising a two-part housing, of which a first housing part (2) bears an illumination means and has a first section (A) of a battery-receiving chamber (B) which is provided with a button (19) and of which the second section (A1) is formed by a second housing part (3), a first contact element and a second contact element which contact the illumination means for connecting the illumination means with a button-cell battery (K) upon insertion of the battery within the battery-receiving chamber, each of said first and said second contact elements having a first end section and a second end section, each housing part (2, 3) receiving respectively one of the two contact elements (14, 40), wherein the first end sections (16, 41) of respective ones of the contact elements (14, 40) are associated respectively with each of two broad surfaces of the battery-receiving chamber (B) and are located opposite one another at a distance which is greater than the distance between the two broad surfaces (29, 49) of the button-cell battery (K), upon insertion of the battery within the battery-receiving chamber and wherein the first end section of the first of the two contact elements, upon actuation of the button, is displaced in a direction toward the first end section of the second contact element, and wherein the second end section of said first contact element extends transversely of said displacement direction to contact a terminal of said illumination means, a portion of said second end section of said first contact element being configured as a spring for exerting a spring force against said illumination means;

wherein the button (19) comprises a flexible-plastic cup, and a cup base (24) is at a distance from a broad surface (29) of the battery upon insertion of the battery within the battery-receiving chamber; and the first end section (16) of the first contact element is located on the base (24) of the cup.

* * * * *